United States Patent [19]

Jones

[11] 4,026,247

[45] May 31, 1977

[54] FLUID COOLED DUMP GRATE

[75] Inventor: Allen Jacob Jones, Grants Pass, Oreg.

[73] Assignee: S. J. Agnew, Tenino, Wash.

[22] Filed: Dec. 15, 1975

[21] Appl. No.: 640,895

[52] U.S. Cl. ..... 122/371; 110/7 R

[51] Int. Cl.[2] ..... F23H 3/04

[58] Field of Search ..... 110/7 R; 122/371, 374, 122/376

[56] References Cited

UNITED STATES PATENTS

| | | | |
|---|---|---|---|
| 1,852,492 | 4/1932 | Tawlks | 122/374 |
| 2,557,013 | 6/1951 | Simpson | 122/374 |
| 3,330,259 | 7/1967 | Wellons | 122/371 |
| 3,570,422 | 3/1971 | Winther | 122/376 |
| 3,665,894 | 5/1972 | Jones | 122/374 |

*Primary Examiner*—Kenneth W. Sprague
*Attorney, Agent, or Firm*—Kolisch, Hartwell, Dickinson & Stuart

[57] ABSTRACT

A dump grate for use in a furnace is rotatably mounted therein and includes fluid coolant tubes sinuously arranged within refractory material comprising a grate plate for circulating coolant fluid. The grate plate is shiftable from a first substantially horizontal fuel supporting position to a nonhorizontal fuel dumping position. A rotatable conduit is arranged beneath the grate plate secured thereto for receiving coolant fluid inlet and discharge tubes for supplying coolant fluid and discharging same from the grate plate coolant tubes. Removable grate bars are arranged on portions of the surface of the grate plate, with the spacing provided between permitting selective varying of airflow through the grate plate for additional cooling purposes.

9 Claims, 5 Drawing Figures

FLUID COOLED DUMP GRATE

BACKGROUND OF THE INVENTION

1. Field of the Invention

The present invention relates to furnaces, and more particularly to a fluid cooled dump grate used in a fuel cell, the fuel cell operable to produce heated gases from burning fuel for use as a drying medium.

In certain industrial applications, it is preferable to use dump grates for supporting burning fuel and then dumping spent fuel into an ash pit. However, because of great heat generated during such burning processes, it is necessary that the dump grate or grates be cooled. Cooling can be effectuated by either introducing air or fluid coolant to contact the dump grates. While introducing air serves to cool dump grates somewhat, it has been found that fluid flowing through coolant tubes disposed in the dump grate is desirable.

Fluid coolant tubes embedded or otherwise used within a grate plate may effectively transfer heat from the grate plate material to the fluid. However, it is often preferable to have grate plates which may be tilted in order to dump spent fuel material into an ash pit. A problem arises in constructing a rotatable dump grate plate which will permit coolant fluid to be continuously introduced and discharged through coolant fluid tubes disposed within the grate plate during a dumping operation. Furthermore, it is also desirable to provide a means so that the amount of air which may be channeled through grate plate openings may be varied.

2. Description of the Prior Art

Rotatable dump grates are known. A typical example is exemplified by U.S. Pat. No. 1,172,022. This patent describes a grate which permits water to be introduced and discharged through a conduit extending around the margin of the grate. Ports arranged in a trunnion of the grate enable water to be introduced into the conduit and discharged therefrom. However, the ports are so arranged to permit introduction and discharge of water only when the grate is in a horizontal position. When the grate is turned or rocked, the ports are turned out of communication with the fluid introduction and discharge means so that coolant fluid may not be continuously circulated through the conduit. Thus, it is readily apparent that the construction described in this patent does not provide for continuous cooling of a dump grate.

A fuel cell is disclosed in U.S. Pat. No. 3,330,259 and includes a hearth composed of water cooled grates around which rises a water cooled upright section so that air can be directed through the hearth and the upright grate section to effect an adequate supply of air to the hearth zone while maintaining the temperature of the zone below a predetermined value. However, it is to be noted that the hearth is not constructed so that it can dump spent fuel material into an ash pit.

SUMMARY OF THE INVENTION

The present invention provides for a dump grate apparatus which supports burning fuel within a furnace and is designed to dump spent fuel into an ash pit. According to the principles of the present invention, a dump grate is rotatably disposed within a fuel cell and is arranged for selective placement in both a substantially horizontal fuel supporting position and a nonhorizontal fuel dumping position. Sinuously arranged within the dump grate thickness are a plurality of coolant fluid tube reaches which provide for fluid passage so that heat may be transferred from the grate plate to the cooling fluid. A rotatable conduit is attached to a bottom surface of the grate plate and upon rotation will selectively shift the grate plate between horizontal and nonhorizontal positions. The rotatable conduit includes coolant fluid introduction and discharge tubes for introducing and discharging coolant fluid from the aforementioned sinuously arranged tube reaches continuously during a dumping operation.

It is a general object of the present invention to provide a furnace dump grate apparatus having fluid coolant tubes arranged within the grate structure, the tubes having headers which will permit introduction and discharge of coolant fluid through the grate plate during a dumping operation.

Another object of the present invention is to provide a furnace dump grate apparatus having a base plate to which is attached an upper layer of refractory material. The refractory material is formed with coolant fluid tubes embedded therein. The refractory material also is provided with enlarged openings at selected regions so that a plurality of grate bars may be attached around portions of the fluid coolant tubes. The spacing of the grate bars may be selectively altered to vary the passage of air through the grate plate structure.

Still a further object of the present invention is to provide a furnace grate apparatus in which coolant fluid may be channeled first through separate dump grates and then channeled through a fuel cell coolant network before being discharged.

Yet another object of the present invention is to provide a furnace dump grate apparatus in which at least two dump grates may be arranged substantially contiguous and be independently and selectively operable for supporting fuel and for dumping spent fuel.

A further object of the present invention is to provide a dump grate apparatus in which refractory material comprising the bulk of the thickness of the dump grate is cast to permit insertion of fluid coolant tubes. Such a structure will prevent breakage of the fluid coolant tubes if the refractory material cracks or breaks due to excessive temperatures.

Additional objects of the present invention reside in the specific construction of the exemplary apparatus hereinafter particularly described in the specification and shown in the several drawings.

BRIEF DESCRIPTION OF THE DRAWINGS

Novel features of the dump grate apparatus in accordance with the present invention will be more readily understood from a consideration of the following description taken together with the accompanying drawings, in which a preferred adaptation is illustrated with the various parts thereof identified by suitable reference characters in each of the views, and in which.

DETAILED DESCRIPTION OF THE INVENTION

Figure 1:
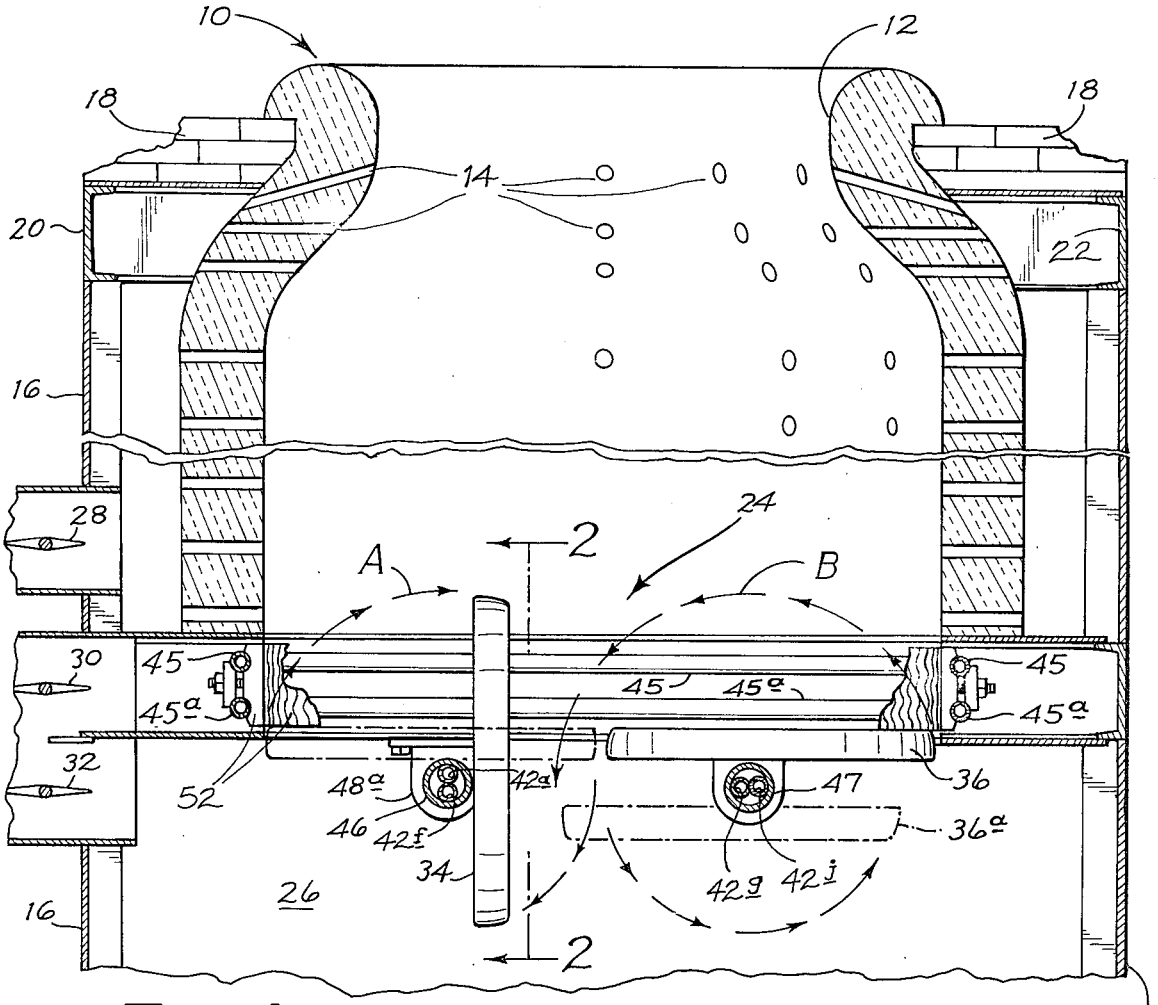
FIG. 1 is a cross-sectional view of a portion of a furnace fuel cell illustrating relative fuel supporting and fuel dumping positions of two dump grates in accordance with the principles of the present invention.
Figure 2:
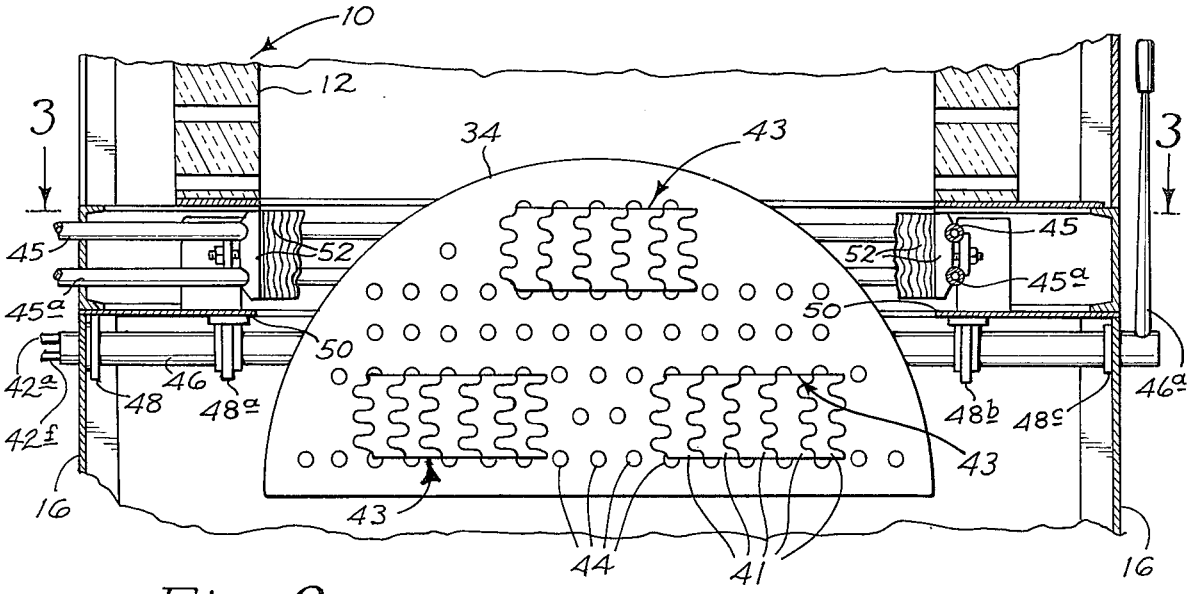
FIG. 2 is a view taken along lines 2—2 of FIG. 1.
Figure 3:
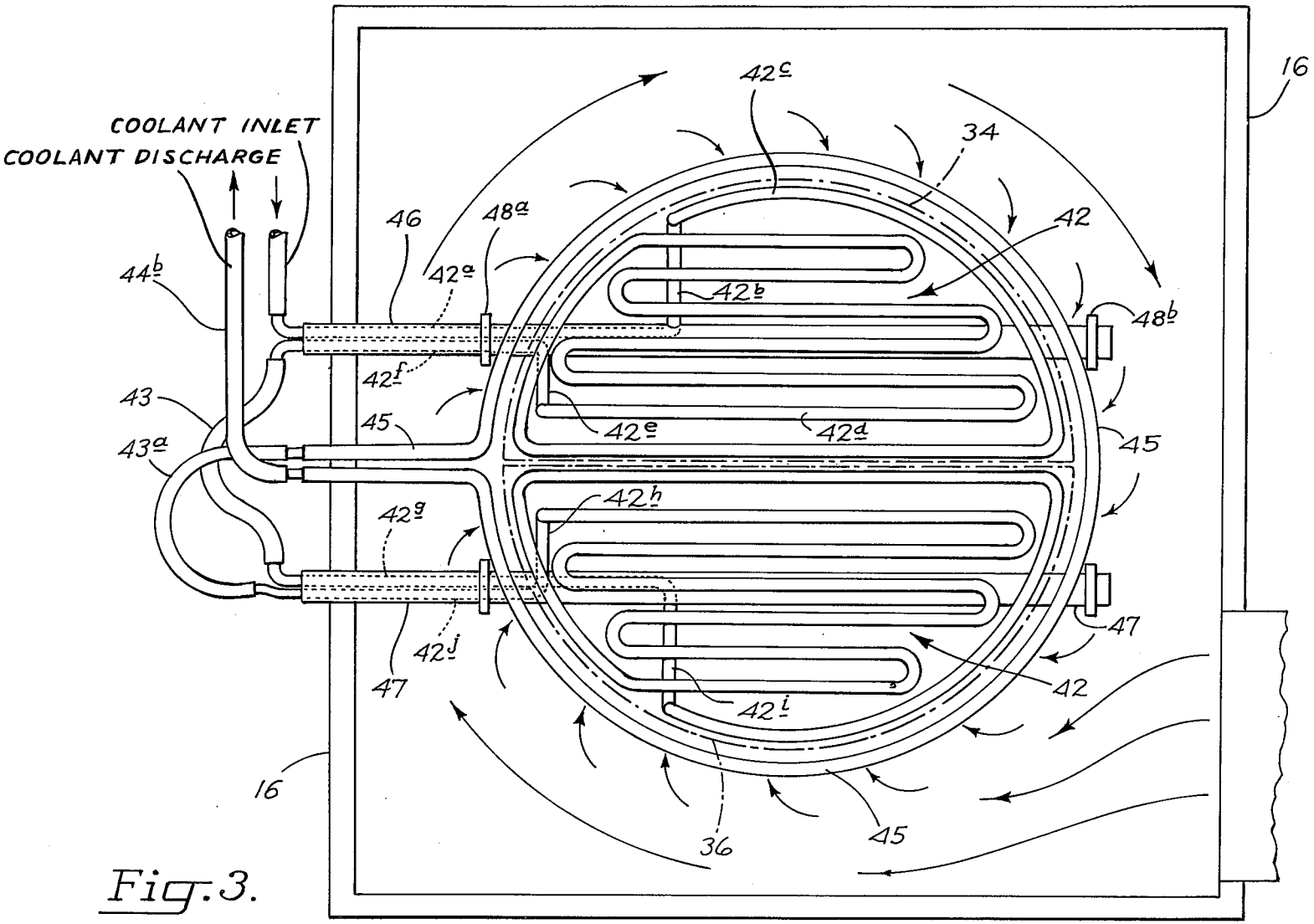
FIG. 3 is a top view of a dump grate apparatus of the present invention with the refractory grate plate material and the base plate therefor removed to expose sinuously arranged fluid coolant tubes.

Turning now to the drawings and referring initially to FIGS. 1–3, a fuel cell is shown generally designated at 10. Fuel cell 10 includes a furnace burning, or combustion, chamber 12. Combustion chamber 12 is provided with a plurality of chamber wall penetrating apertures 14 which permit airflow therethrough. An outer shroud 16 surrounds combustion chamber 12 and a firebrick construction 18 is supported upon frame channel members 20, 22 and provides additional heat insulation. Arranged intermediate of combustion chamber 12 is dump grate apparatus in accordance with the principles of the present invention generally designated at 24. Disposed beneath dump grate apparatus 24 is an ash pit 26 which receives spent fuel.

Adjustable air admitting dampers 28, 30 and 32 are arranged for admitting air into combustion chamber 12 and beneath dump grate apparatus 24.

Figure 4:
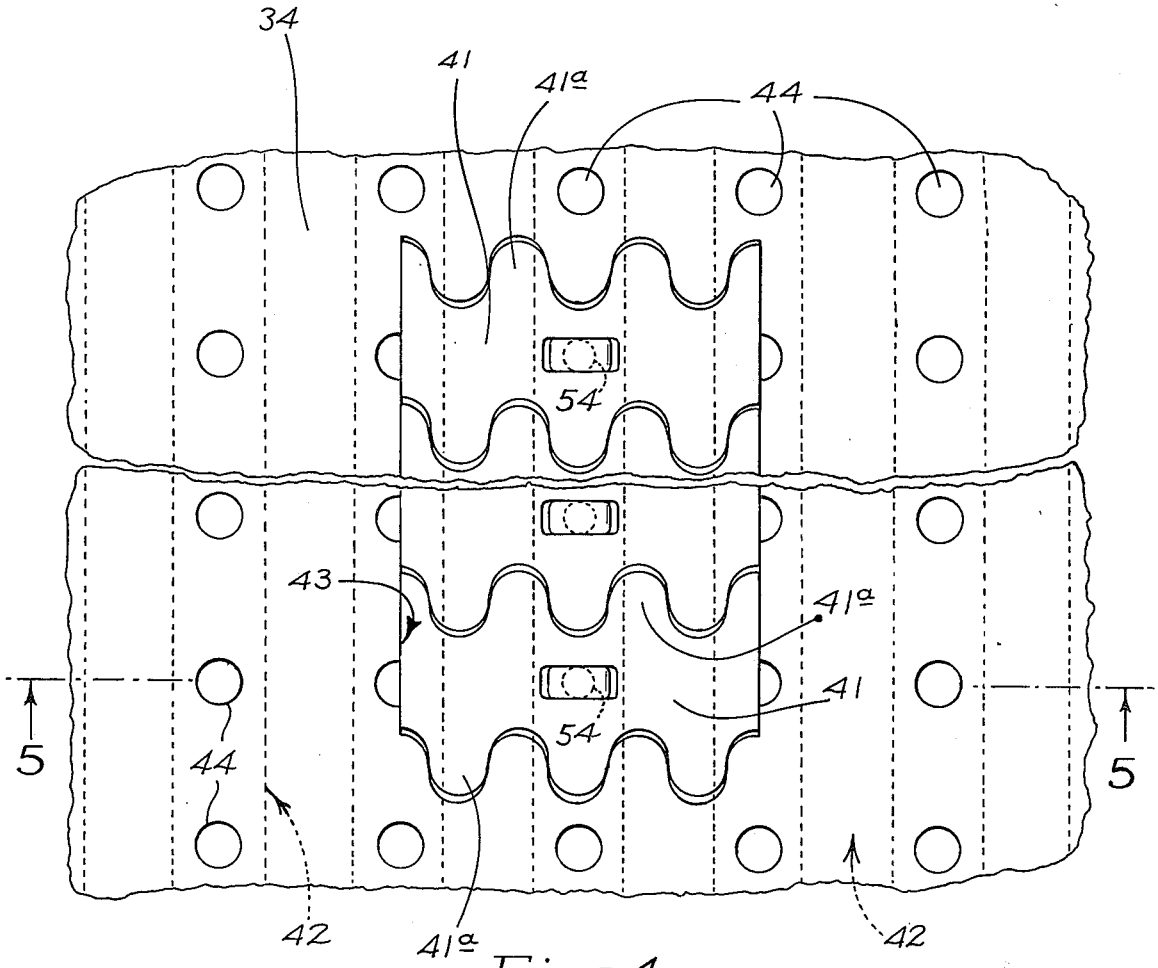
FIG. 4 is an enlarged view of the refractory material comprising the grate plate structure illustrating insertable sinuously edged grate plate bars.
Figure 5:
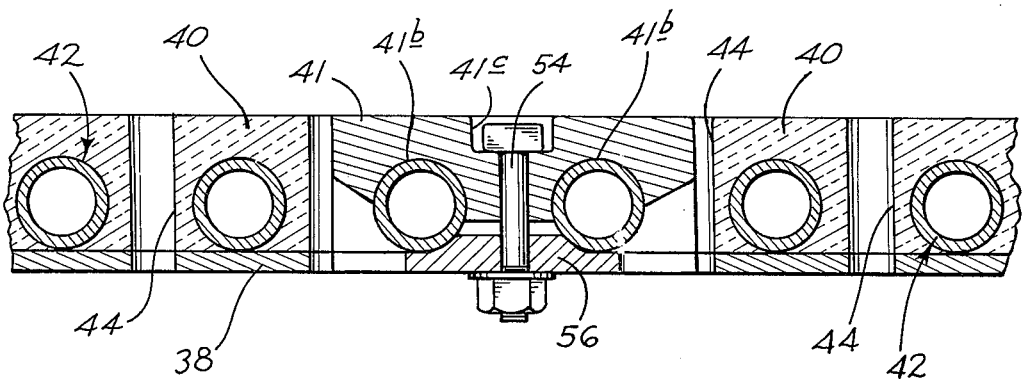
FIG. 5 is a view taken along lines 5—5 of FIG. 4.

A preferred embodiment of dump grate apparatus 24 is illustrated in FIGS. 1–5. Dump gate apparatus 24 may include two dump grates 34 and 36. As shown in FIG. 1, dump grate 34 is in a vertical position for dumping spent fuel while dump grate 36 is in a fuel supporting substantially horizontal position. With reference directed particularly to FIGS. 1, 2 and 5, specific features of dump grate plates 34 and 36 will be described. Each dump grate includes a semicircular base plate 38 to which is attached a layer of refractory material 40. Upper layer 40 of each dump grate is castable refractory material and has supported and embedded therein a fluid coolant tube generally designated at 42. A plurality of air channeling bores 44 are provided through base plate 38 and upper refractory layer 40.

As can be best seen from a consideration of FIGS. 1 and 2, a rotatable conduit 46 is provided for grate plate 34. A similar conduit 47 is provided for grate plate 36, but because the conduits are similar, only conduit 46 will be described in detail. Conduit 46 is rotatably supported in bearings **48, 48*a*, 48*b* and 48*c*. Conduit 46 is secured, as by welding, to base plate 38. Bearings 48, 48*a*, etc. are secured to a frame support 50. As shown in FIGS. 1 and 2, conduit 46 may be rotated clockwise in the direction of arrows A to dump spent fuel material into ash pit 26. Arrows B indicate a dumping rotational direction for grate plate 36. FIG. 1 shows grate plate 36 completely rotated to an inverted dumping position as shown by dotted lines 36*a*. Conduit 46 may be rotated mechanically or by use of a handle shown at 46*a*.**

An important feature of the present invention resides in the fact that coolant fluid may flow through tubes 42 during both horizontal and nonhorizontal positioning of dump grates 34 and 36. Specifically, as can be seen in FIG. 3, conduit 46 receives and has extending therethrough a coolant fluid introduction tube **42*a* which is connected to a header 42*b*. Header 42*b* has an opposite end connected to a first coolant fluid tube reach 42*c*. Reach 42*c* is connected to a plurality of sinuously arranged tube reaches which terminate in a final tube reach 42*d*. Final tube reach 42*d* is connected to a header 42*e* which in turn is connected to a coolant fluid discharge tube 42*f* extending through conduit 46.**

It is to be noted that coolant fluid discharge tube **42*f* of grate plate 34 is channeled into a second grate plate coolant fluid introduction tube 42*g* through flexible hose connection 43. Coolant fluid travels through introduction tube 42*g* and through a header 42*h* to additional sinuously arranged coolant fluid tubes for discharge through header 42*i* to discharge tube 42*j*. Tube 42*j* extending through conduit 47 leads to a further flexible tube 43*a* for passage into a coolant tube 45 for discharge through a flexible conduit 44*b*. Coolant tube 45 is provided adjacent to an interior peripheral segment of chamber 12 with a plurality of interconnected grate bar plates 52 secured thereto. This organization permits air to pass between grate bars 52 into the fuel cell, with fluid in tube 45 cooling the grate bars. An additional coolant tube 45*a* is shown in FIG. 2 disposed beneath tube 45.**

Because tubes **42*a* and 42*f* are flexibly connected to supply and discharge lines, respectively, leading to a supply of coolant fluid, it may be appreciated that as conduit 46 is rotated, tubes 42*a* and 42*f* are permitted likewise to rotate along with conduit 46. As a consequence, coolant fluid may be continuously channeled from tube 42*a* through the plurality of tube reaches for discharge through tube 42*f* during horizontal and nonhorizontal positioning of grate plate means 34. Similarly, the other flexible connections permit coolant fluid to continuously cool dump grate 36** during all operations.

Additional features of the present invention may be appreciated from a consideration of removable contact grate bars 41 shown in FIGS. 4 and 5. Grate bars 41 have sinuous edges and fingers **41*a* adapted to interlock with each other in openings formed on base plate 38 and layer 40 generally indicated at 43. Openings 43 are substantially rectangular and of a size to receive a plurality of side-by-side grate bars. The end margins of the openings are also sinuous. Bars 41 are provided with semicircular indentations 41*b* along their undersides so that the bars may fit reaches of tubes 42 which extend through openings 43. Each bar 41 is provided with a recess 41*c* to receive the head of a holding bolt 54 extending therethrough. A clamp bar 56 received on the other end of bolt 54 engages the undersides of the tube reaches in opening 43 to retain the grate bars in the opening. By varying the number and spacing between grate bars 41 in an opening 43 the airflow from beneath grate plate 38** may be varied over a preselected tube area.

While the invention has been particularly described and shown with reference to the foregoing preferred embodiment thereof, it will be understood by those skilled in the art that other changes in form and detail may be made therein without departing from the spirit and scope of the present invention as defined in the appended claims.

It is claimed and desired to secure by Letters Patent:

1. Apparatus for supporting burning fuel within a furnace and operable for dumping said fuel, when spent, comprising:

grate means for supporting fuel thereon including a grate coolant tube for receiving fluid disposed beneath an upper surface of said grate means, said coolant tube including initial and final tube reaches and a plurality of sinuously interconnected tube reaches which connect said initial tube reach to said final tube reach, said initial tube reach permitting coolant fluid introduced thereinto to successively pass through said initial reach, said plurality of sinuous tube reaches and said final reach to be discharged therefrom, thus enabling heat to be transferred from said grate means to said coolant fluid;

means for tilting said grate means from a substantially horizontal fuel supporting position to a nonhorizontal position for permitting spent fuel to fall from said upper surface, said tilting means including a member connected to the bottom of said grate means and extending substantially transversely thereof;

said member being rotatably journaled within bearing support means and selectively operable for rotation about its longitudinal axis for shifting said grate means between its substantially horizontal and nonhorizontal positions; and means for continuously introducing and discharging coolant fluid into and from said tube when said grate means is disposed both substantially horizontally and nonhorizontally.

2. Apparatus as described in claim 1, wherein said rotatable member is a conduit sized to receive a coolant fluid introduction tube and a coolant fluid discharge tube, said coolant fluid introduction tube having a header connected to said initial tube reach and said coolant fluid discharge tube having a return header connected to said final tube reach.

3. Apparatus as described in claim 2, which further comprises a flexible connector connecting said coolant fluid introduction tube to a coolant fluid supply allowing said coolant fluid introduction tube to rotate with said rotatable conduit.

4. Apparatus as described in claim 3 wherein an additional grate means constructed substantially similarly to said first mentioned grate means is disposed adjacent to said first mentioned grate means, said additional grate means having a coolant fluid introduction tube flexibly connected to said fluid discharge tube of said first dump grate, and also having a coolant fluid discharge tube.

5. Apparatus as described in claim 4, which further comprises second tilting means including a rotatable conduit connected to said additional grate means, operable independently of said first mentioned rotatable conduit, said coolant fluid introduction and discharge tubes of said additional grate means being disposed therein.

6. Apparatus as described in claim 5, wherein said furnace includes furnace coolant tubes substantially surrounding an internal peripheral segment of said furnace for cooling the same and said coolant fluid discharge tube of said additional grate means is flexibly connected to furnace coolant tubes for tilting relative thereto.

7. Apparatus for supporting burning fuel within a furnace and operable for dumping said fuel, when spent, comprising:

grate means for supporting fuel thereon including a grate coolant tube for receiving fluid, said grate means also including a base plate and an upper layer of refractory material attached thereto, said refractory material defining a thickness in which said tube is supported and substantially embedded;

means for tilting said grate means from a substantially horizontal fuel supporting position to a nonhorizontal position for permitting spent fuel to fall from said upper surface; and means for continuously introducing and discharging fluid into and from said tube when said grate means is disposed both substantially horizontally and nonhorizontally.

8. Apparatus as described in claim 7, wherein said base plate and said upper layer have apertures extending therethrough interspersed between reaches of said fluid coolant tubes to permit flow of air through said grate means.

9. Apparatus as described in claim 8, wherein said upper layer is provided with at least one enlarged opening having an expanse of said coolant fluid tube therein, said opening communicating with several of said apertures and having sinuous edges arranged to receive a plurality of grate bars having corresponding sinuous edges, said grate bars being individually removably secured to said expanse of said coolant fluid tube.

* * * * *

UNITED STATES PATENT AND TRADEMARK OFFICE

CERTIFICATE OF CORRECTION

PATENT NO. : 4,026,247

DATED : May 31, 1977

INVENTOR(S) : Allen Jacob Jones

It is certified that error appears in the above-identified patent and that said Letters Patent are hereby corrected as shown below:

In Column 1, line 34, change "1,172,022" to --1,172,002--.

In Column 3, line 25-26, delete "fuel supporting" and add after position --for supporting fuel--.

In Column 3, line, 37, after "rotatable" insert --member or--.

Signed and Sealed this

Ninth Day of May 1978

[SEAL]

Attest:

RUTH C. MASON
Attesting Officer

LUTRELLE F. PARKER
Acting Commissioner of Patents and Trademarks